US006354959B1

(12) United States Patent
Nicolette et al.

(10) Patent No.: US 6,354,959 B1
(45) Date of Patent: Mar. 12, 2002

(54) LIGHTWEIGHT VIBRATION ABSORBING HOSEL FOR GOLF PUTTERS

(75) Inventors: Michael R. Nicolette, Cave Creek; Lou C. Beebe, Phoenix; John K. Solheim, Phoenix; Michael J. Nelson, Phoenix; Douglas W. Anderson, Glendale, all of AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/496,439

(22) Filed: Feb. 2, 2000

(51) Int. Cl.[7] ..... A63B 53/04

(52) U.S. Cl. ..... 473/305; 476/313; 476/332; 476/340

(58) Field of Search ..... 473/304–315, 473/324, 332, 313, 340

(56) References Cited

U.S. PATENT DOCUMENTS 4,832,344 A 5/1989 Werner ..... 273/163
5,275,409 A * 1/1994 Currie
5,326,106 A * 7/1994 Meyer
5,647,807 A * 7/1997 Nagamoto
5,651,932 A * 7/1997 Butler
5,795,243 A * 8/1998 Chang
5,797,806 A 8/1998 Butler ..... 473/10
5,885,170 A * 3/1999 Takeda
6,231,458 B1 * 5/2001 Cameron

* cited by examiner

*Primary Examiner*—Stephen Blau
(74) *Attorney, Agent, or Firm*—Darrell F. Marquette

(57) ABSTRACT

A golf putter includes a head having a face arranged for impacting a golf ball, a hosel having a lower end connected to the head, and a shaft connected to an upper end of the hosel. The hosel includes a leg portion extending upwardly from the head, and at least one vibration absorbing insert is disposed in a hole formed in the hosel leg portion. The vibration absorbing insert is preferably formed of polyurethane. The head may be formed of heavyweight material such as stainless steel, and the hosel may be formed of lightweight material such as titanium.

12 Claims, 2 Drawing Sheets

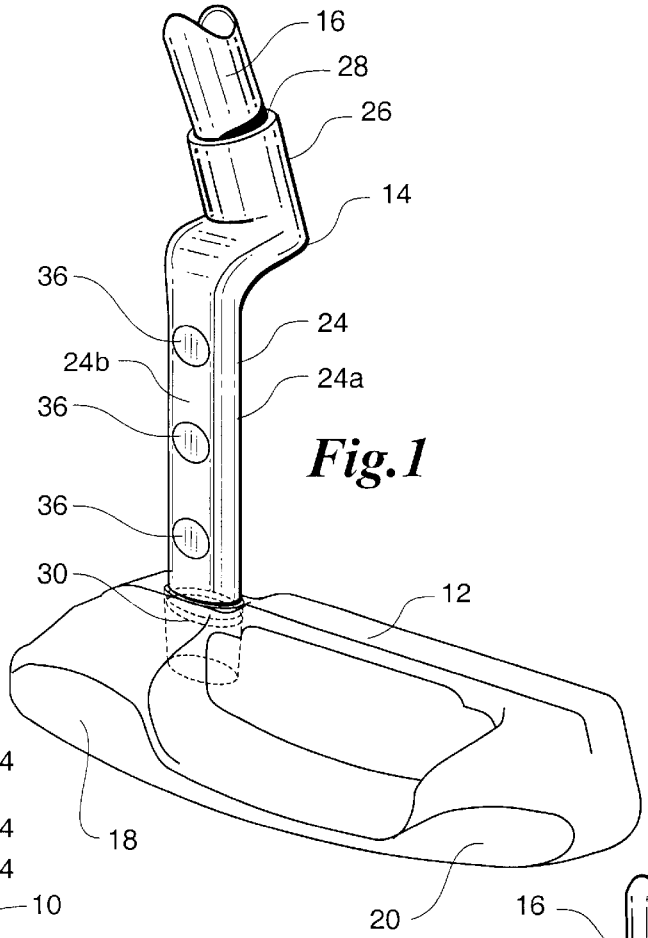
Fig.1
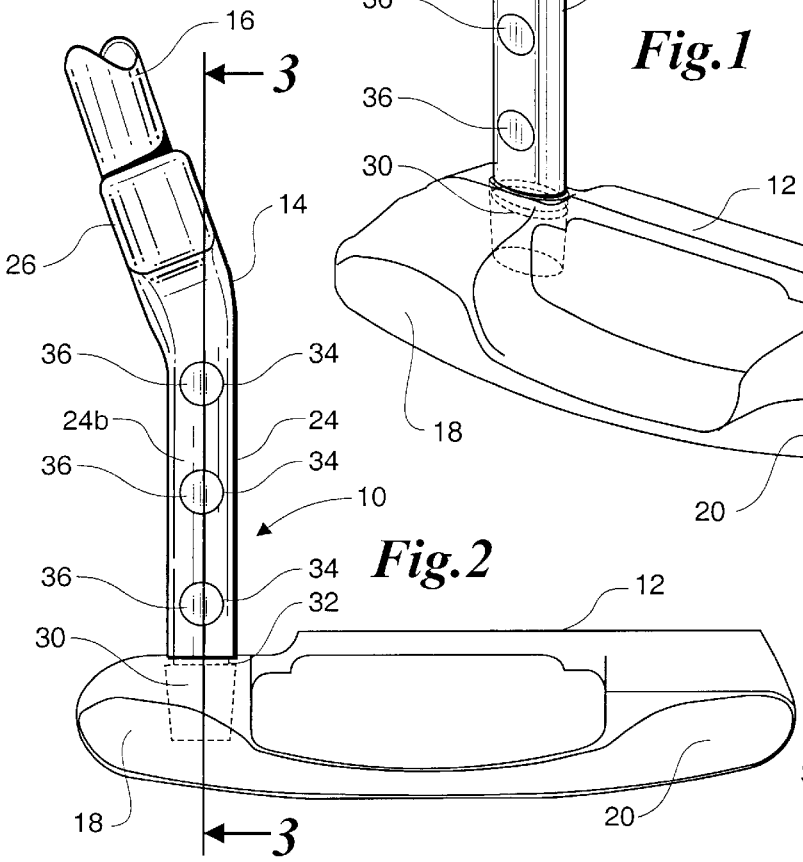
Fig.2
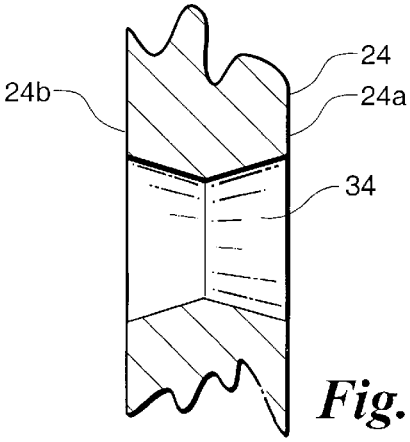
Fig.3a
Fig.3b
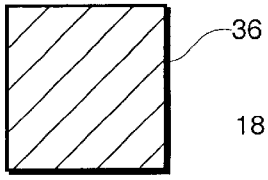
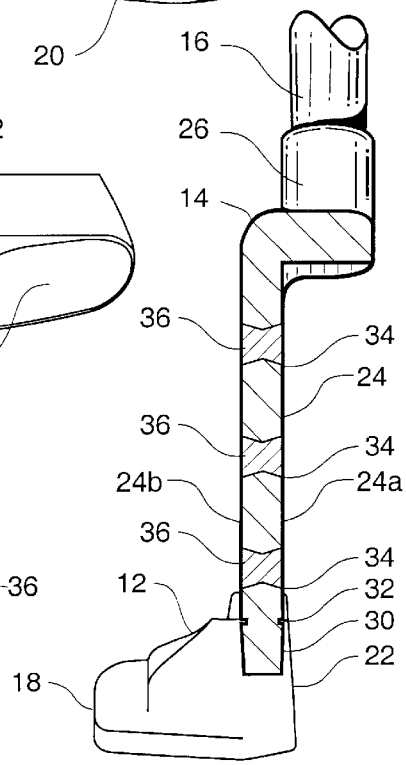
Fig.3

16
42
40
40a
44
46
40b
44
38
46
12
18
20

16
52
48
54
56
50
54
56
50b
50a
54
56
54
56
12
18
20

62
58
64
66
60
64
66
60b
64
60a
66
12
18
20

LIGHTWEIGHT VIBRATION ABSORBING HOSEL FOR GOLF PUTTERS

BACKGROUND OF THE INVENTION

This invention relates generally to golf equipment and, in particular, to a lightweight vibration absorbing hosel for golf putters.

It is known that golf putters have included face inserts for many years. When these face inserts are formed of non-metallic material such as plastic, they provide a golfer with soft feel when impacting a golf ball. A drawback of manufacturing golf putters with face inserts is that it is time consuming and labor intensive. Also, some golfers may prefer a putter without a face insert. Therefore, a need exists for a golf putter having soft feel upon impact with a golf ball but without a face insert. SUMMARY OF THE INVENTION The present invention provides a hosel for a golf putter which includes a head with a face for impacting a golf ball. The golf putter also includes a shaft connected to an upper end of the hosel. The hosel has a lower end connected to the head, and a leg portion of the hosel extends upwardly from the head. The hosel leg portion has a front side and a rear side. At least one vibration absorbing insert is disposed in the hosel leg portion. The vibration absorbing insert extends through the hosel leg portion from the front side to the rear side thereof. In a preferred embodiment of the hosel the vibration absorbing insert is formed of polyurethane and it is disposed in a hole which extends through the hosel leg portion from the front side to the rear side thereof. The head may be formed of heavyweight material such as stainless steel, and the hosel may be formed of lightweight material such as titanium. Various embodiments of the hosel utilize two, three or four vibration absorbing inserts.

DESCRIPTION OF THE DRAWINGS

FIG. 1 is a perspective view of a golf putter having a lightweight vibration absorbing hosel according to the present invention;

FIG. 2 is a rear elevational view of the golf putter of FIG. 1;

FIG. 3 is a sectional view taken along lines 3—3 of FIG. 2;

FIG. 3*a* is an enlarged fragmentary view of a portion of the hosel shown in FIG. 1;

FIG. 3*b* is an enlarged cross sectional view of a vibration absorbing insert of the present invention.

DESCRIPTION OF THE PREFERRED EMBODIMENT

Figures 4, 5, 6:
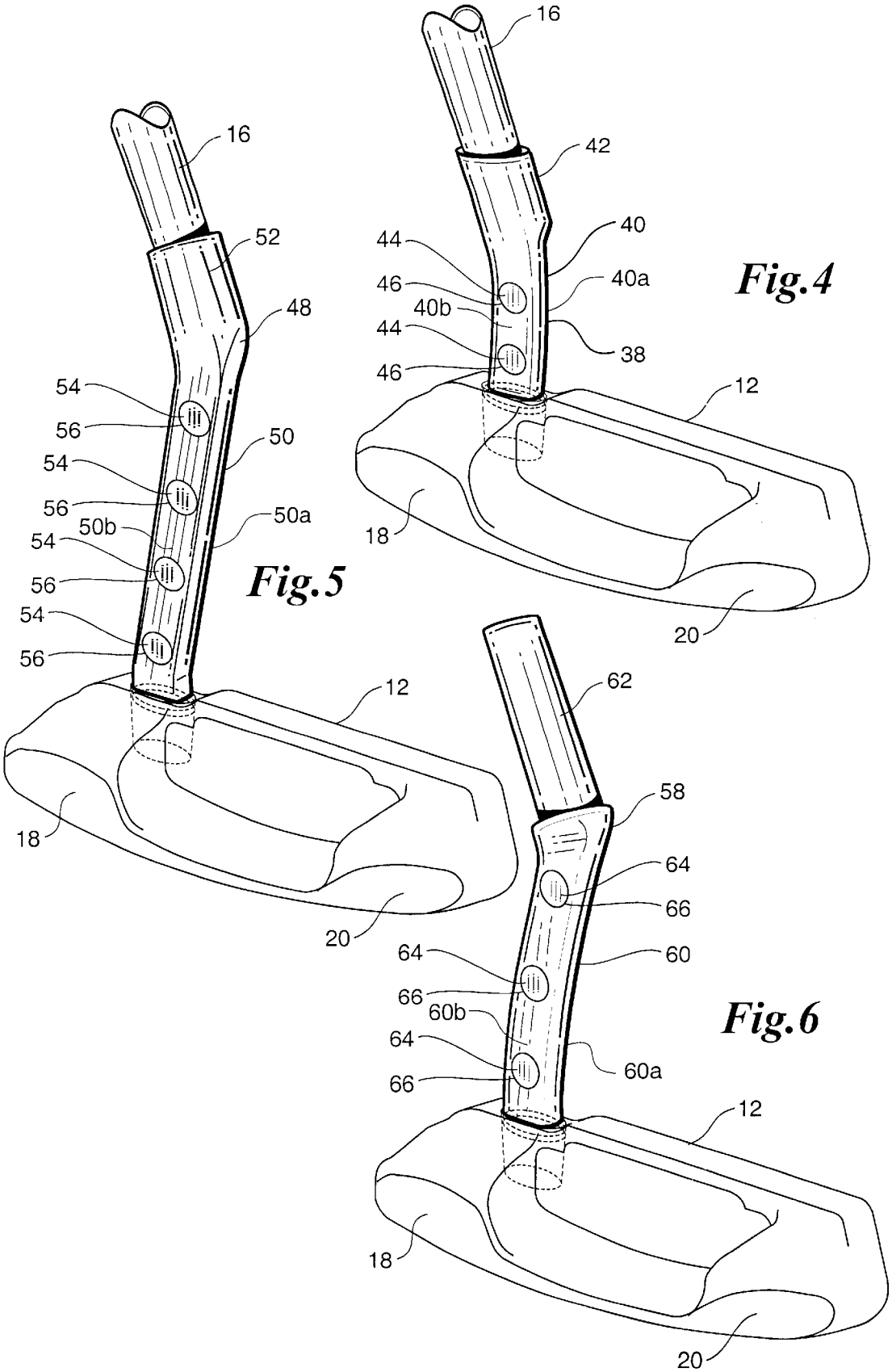
FIGS. 4, 5 and 6 are perspective views of golf putters having lightweight vibration absorbing hosels according to various modifications of the present invention.

Referring to FIGS. 1–3, a golf putter 10 includes a head 12, a hosel 14 and a shaft 16. The head 12 may be of any suitable configuration including a conventional configuration with heel and toe weights 18, 20. The head 12 has a face 22 arranged for impact with a golf ball. The hosel 14 has a leg portion 24 extending upwardly from the head 12. The hosel leg portion 24 has a front side 24*a* and a rear side 24*b*. A boss 26 at an upper end of the hosel 14 is provided with a bore 28 into which a tip end of the shaft 16 is received. A lower end of the hosel 14 has a projection 30 which is disposed in a complementary opening formed in the head 12 adjacent the heel weight 18. The projection 30 is secured in the opening by suitable adhesive such as epoxy. A groove 32 in the projection 30 collects any excess adhesive.

The head 12 is preferably made of heavyweight material such as stainless steel or bronze having a first density, and the hosel 14 is preferably made of lightweight material such as titanium or aluminum having a second density. It will be understood that the first density is greater than the second density. This combination of heavyweight and lightweight materials results in more mass in the head 12 and less mass in the hosel 14 which gives the combined mass of the head 12 and the hosel 14 a lower center of gravity.

The hosel 14 has a plurality of holes 34 extending through the leg portion 24 from the front side 24*a* to the rear side 24*b* thereof and three inserts 36 formed of vibration absorbing material such as polyurethane are disposed in the holes 34. As best seen in FIGS. 3*a* and 3*b*, the holes 34 have an hourglass shape and the inserts 36 have a cylindrical preformed shape. Since the inserts 36 are partially deformed into an hourglass shape when they are inserted in the holes 34, they are retained in the holes 34 without using adhesive. The head 12 will have even more mass because the vibration absorbing material forming the inserts 36 is about four times less dense than the lightweight material forming the hosel 14. It will be understood that by changing the number and positioning of the inserts 36, the putter 10 may be fine tuned to a golfer's desired feel when impacting a golf ball.

Referring to FIG. 4, a hosel 38 has a leg portion 40 that is shorter and shaped differently than the leg portion 24 of the hosel 14. The hosel leg portion 40 has a front side 40*a* and a rear side 40*b*. A boss 42 similar to the boss 26 is provided at an upper end of the leg portion 40, and a projection (not shown) similar to the projection 30 is provided at a lower end of the leg portion 40. Two inserts 44 made of vibration absorbing material are disposed in two holes 46 formed in the hosel leg portion 40.

Referring to FIG. 5, a hosel 48 has a leg portion 50 that is longer and shaped differently than the leg portion 24 of the hosel 14. The hosel leg portion 50 has a front side 50*a* and a rear side 50*b*. A boss 52 similar to the boss 26 is provided at an upper end of the hosel leg portion 48, and a projection (not shown) similar to the projection 30 is provided at a lower end of the hosel leg portion 50. Four inserts 54 made of vibration absorbing material are disposed in four holes 56 formed in the hosel leg portion 50.

Referring to FIG. 6, a hosel 58 has a leg portion 60 that is shaped differently than the leg portion 24 of hosel 14. The hosel leg portion 60 has a front side 60*a* and a rear side 60*b*. A tapered extension 62 is provided on an upper end of the hosel leg portion 60, and a projection (not shown) similar to the projection 30 is provided at a lower end of the hosel leg portion 60. It will be understood that the tip end of the shaft 16 will fit over the tapered extension 62 in order to attach the shaft 16 to the hosel 58. Three inserts 64 made of vibration absorbing material are disposed in three holes 66 formed in the hosel leg portion 60.

The vibration absorbing material that forms the inserts 36, 44, 54 and 64 is preferably polyurethane sold under the trade name DYNAFLEX by GLS Corporation with a hardness in the range of Shore A 30 to 80. A preferred range of hardness for the inserts 36, 44, 54 and 64 is Shore A 50 to 60. The particular hardness of the inserts 36, 44, 54 and 64 may be varied within these ranges to fine tune the golf putter 10 to a golfer's desired feel when impacting a golf ball.

What is claimed is:

1. In a golf putter including a head having a face arranged for impacting a golf ball, a hosel having a lower end connected to said head, and a shaft connected to an upper end of said hosel, said hosel comprising:

a leg portion extending upwardly from said head, said leg portion having a front side and a rear side; and at least one vibration absorbing insert disposed in said leg portion of said hosel, said vibration absorbing insert extending through said hosel leg portion from said front side to said rear side thereof wherein said insert is completely surrounded by said hosel leg portion except at said front side and said rear side.

2. In the golf putter of claim 1, further comprising a plurality of vibration absorbing inserts disposed in said hosel and extending through said hosel leg portion from said front side to said rear side thereof.

3. In the golf putter of claim 2, wherein said plurality of vibration absorbing inserts comprises two inserts.

4. In the golf putter of claim 2, wherein said plurality of vibration absorbing inserts comprises three inserts.

5. In the golf putter of claim 2, wherein said plurality of vibration absorbing inserts comprises four inserts.

6. In the golf putter of claim 1, wherein said vibration absorbing insert is disposed in a hole formed in said hosel leg portion and wherein said hole extends through said hosel leg portion from said front side to said rear side thereof.

7. In the golf putter of claim 6, wherein said hole has an hourglass shape.

8. In the golf putter of claim 1, wherein said vibration absorbing insert is formed of polyurethane.

9. In the golf putter of claim 1, wherein said head is formed of heavyweight material having a first density and said hosel is formed of lightweight material having a second density, and wherein said first density is greater than said second density.

10. In the golf putter of claim 9, wherein said heavyweight material is stainless steel and wherein said lightweight material is titanium.

11. A golf putter comprising:

a head having a face arranged for impacting a golf ball;

a hosel having a lower end connected to said head and a leg portion extending upwardly from said head, said hosel leg portion having a front side and a rear side;

a vibration absorbing insert disposed in said hosel leg portion, said vibration absorbing insert extending through said hosel leg portion from said front side to said rear side thereof wherein said insert is completely surrounded by said hosel leg portion except at said front side and said rear side; and a shaft connected to an upper end of said hosel.

12. The golf putter of claim 11, wherein said vibration absorbing insert is disposed in a hole in said hosel leg portion, and wherein said hole has an hourglass shape and extends through said hosel leg portion from said front side to said rear side thereof.

* * * * *